US009583301B2

(12) United States Patent
Duan et al.

(10) Patent No.: US 9,583,301 B2
(45) Date of Patent: Feb. 28, 2017

(54) METAMATERIAL HIGH-POWER MICROWAVE SOURCE

(71) Applicant: University of Electronic Science and Technology of China, Chengdu, Sichuan (CN)

(72) Inventors: Zhaoyun Duan, Sichuan (CN); Xianfeng Tang, Sichuan (CN); Xinwu Ma, Sichuan (CN); Xiang Huang, Sichuan (CN); Zhanliang Wang, Sichuan (CN); Tao Tang, Sichuan (CN); Yanshuai Wang, Sichuan (CN); Yubin Gong, Sichuan (CN)

(73) Assignee: University of Electronic Science and Technology of China, Chengdu, Sichuan (CN)

( * ) Notice: Subject to any disclaimer, the term of this patent is extended or adjusted under 35 U.S.C. 154(b) by 0 days.

(21) Appl. No.: 14/880,172

(22) Filed: Oct. 9, 2015

(65) Prior Publication Data

US 2016/0126051 A1 May 5, 2016

(30) Foreign Application Priority Data

Jun. 18, 2015 (CN) ..... 2015 1 0342200

(51) Int. Cl.
*H01J 7/46* (2006.01)
*H01J 23/16* (2006.01)
*H01J 25/34* (2006.01)

(52) U.S. Cl.
CPC ..... *H01J 23/16* (2013.01); *H01J 25/34* (2013.01)

(58) Field of Classification Search
CPC ... H01J 24/16; H01J 25/34; H01P 3/00; H01P 5/00
USPC ..... 315/39
See application file for complete search history.

(56) References Cited

U.S. PATENT DOCUMENTS 3,754,198 A * 8/1973 Anghel ..... H01P 1/20372 333/204
5,006,825 A * 4/1991 Guilbert ..... H01J 23/46 315/39.53
5,119,051 A * 6/1992 Myer ..... H01P 7/06 330/295
2010/0283389 A1* 11/2010 Frederick ..... H01J 65/044 315/39
2011/0105019 A1* 5/2011 Tavassoli Hozouri .... H01P 5/08 455/39

* cited by examiner

*Primary Examiner* — Don Le

(57) ABSTRACT

A metamaterial high-power microwave source relates to the fields of vacuum electronic technology, particle physics, and accelerators, including: a cathode, a metamaterial slow-wave structure (SWS), a waveguide and coaxial line coupler located at one end of the metamaterial SWS and a collector component located at the other end of the metamaterial SWS. The metamaterial SWS provided by the present invention is greatly smaller than a rectangular waveguide having the same frequency, so as to realize a miniaturization of devices and facilitate integration with semiconductor devices. The waveguide and coaxial line coupler has a good transmission characteristic and a low reflection in a relatively wide frequency band, which guarantees a high-efficient coupling output of a signal. Moreover, the metamaterial high-power microwave source has a high-power output and a pulsed output power reaching a megawatt level.

8 Claims, 5 Drawing Sheets

METAMATERIAL HIGH-POWER MICROWAVE SOURCE

CROSS REFERENCE OF RELATED APPLICATION

The present invention claims priority under 35 U.S.C. 119(a-d) to CN 201510342200.X, filed Jun. 18, 2015.

BACKGROUND OF THE PRESENT INVENTION

Field of Invention

The present invention relates to the fields of vacuum electronic technology, particle physics, and accelerators, and more particularly to a sheet electron beam/multi-electron beam metamaterial high-power microwave source, which is high-powered, high-efficient, miniaturized, easy to be manufactured, and liable to integrate with semiconductor devices.

Description of Related Arts

In the microwave frequency band, compared with the semiconductor devices, although vacuum electron devices have the high power and the high efficiency, the vacuum electron devices have the large volume, the heavy weight, and the poor consistency. With the rapid development of the semiconductor devices, the vacuum electron devices, such as the traveling-wave tube, the backward wave oscillator, the klystrons, and the magnetrons, are facing great challenges in the fields of communication, radar, guidance, electronic countermeasures, microwave heating, accelerators, and controlled thermonuclear fusions. Thus, the vacuum electron devices are urgently required to develop toward the miniaturization while further improving the output power, so as to meet the challenges from the semiconductor devices. Compared with the conventional vacuum electron devices, the sheet beam metamaterial high-power microwave source has the advantages of both the metamaterial and the sheet electron beam. Firstly, the resonance characteristic of the metamaterial leads to the high interaction impedance of the metamaterial slow-wave structure (SWS), so the sheet beam metamaterial high-power microwave source has the high power and the high efficiency. Secondly, the square metallic waveguide loaded with the metamaterial is able to work under the cut-off frequency of the empty waveguide, so the structure size of the sheet beam metamaterial high-power microwave source is greatly decreased, which contributes to the miniaturization of the vacuum electron devices. Thirdly, the sheet electron beam is able to transmit the high current with the small size, which further contributes to increasing the output power of the vacuum electron devices. Fourthly, the sheet electron beam is beneficial to expand the interaction area, so as to further increase the efficiency of the vacuum electron devices. Because the sheet electron beam/multi-electron beam metamaterial high-power microwave source has the advantages of both the metamaterial and the sheet electron beam, the sheet electron beam/multi-electron beam metamaterial high-power microwave source has the obvious advantages over the semiconductor devices in the competition of the higher frequency band (millimeter wave frequency band and terahertz frequency band). Thus, the sheet electron beam/multi-electron beam metamaterial high-power microwave source has attracted more and more attention of the scholars.

In 2005, the Spanish scholars, including Esteban, proposed a rectangular waveguide loaded with a two-dimensional metal rod array (one of the metamaterials) and illustrated that the rectangular waveguide is able to propagate the quasi transverse magnetic (TM) wave in principle (J. Esteban, et al., *IEEE Trans. Microwave Theory Tech.,* 53 (4), 1506-1514, 2005). However, the structure of the rectangular waveguide has no natural electron beam channel and has the low interaction efficiency. Thus, the rectangular waveguide is not applicable in the vacuum electron devices. In 2014, the Chinese scholar Zhaoyun Duan and his American colleagues proposed a single-negative metamaterial built by a Complementary Electric Split Ring Resonator (CeSRR), as shown in FIG. 1. This metamaterial-loaded waveguide is able to propagate the quasi-TM wave and has the natural sheet electron beam channel (Z. Y. Duan, et al., *Phys. Plasmas,* 21 (10), 103301, 2014). Moreover, as shown in FIG. 2, the metamaterial-loaded waveguide can be regarded as a novel SWS with the high interaction impedance (more than 750 ohms), larger than the interaction impedance of the helix in the S band (about 100-200 ohms) and the interaction impedance of the coupled cavity in the S band (about 300-400 ohms). However, this work merely theoretically analyzes the high-frequency characteristics of the metamaterial SWS, not involving the nonlinear effect of the beam-wave interaction and the related components, such as the energy output devices, the cathode, and the collector. Hence, the work merely theoretically predicts that the CeSRR is able to serve as the high-power microwave source, and thus mainly focuses on the metamaterial SWS which is merely one of the components of the high-power microwave radiation source.

SUMMARY OF THE PRESENT INVENTION

Accordingly, in order to overcome deficiencies of conventional technologies and take advantages of a sheet electron beam/multi-electron beam, the present invention provides a realizable metamaterial high-power microwave source. The metamaterial high-power microwave source of the present invention has high power, high efficiency, miniaturized size, simple manufacture, and liability to integrate with semiconductor devices.

The present invention adopts the following technical solutions.

A metamaterial high-power microwave source comprises a cathode, a metamaterial slow-wave structure (SWS), a waveguide and coaxial line coupler which is located at one end of the metamaterial SWS, and a collector component which is located at the other end of the metamaterial SWS, wherein:

the metamaterial SWS comprises a square waveguide and a metamaterial which is fixed at a central position of an inner cavity of the square waveguide;

the waveguide and coaxial line coupler comprises a coupling waveguide and a coaxial line;

the coupling waveguide comprises a rectangular coupling waveguide, a waveguide baffle which is located at one end of the rectangular coupling waveguide, and a waveguide connecting flange, located at the other end of the rectangular coupling waveguide, for fixedly connecting the rectangular coupling waveguide with the square waveguide;

the coaxial line comprises a coaxial probe, two coaxial media, a medium fixing cylinder, and an output transferring cylinder;

a central position of a lateral surface of the rectangular coupling waveguide has a circular hole thereon; one end of the medium fixing cylinder is embedded in an external side of the circular hole; the other end of the medium fixing cylinder is embedded in the output transferring cylinder; the medium fixing cylinder is filled with the two coaxial media;

one end of the coaxial probe is fixedly connected with the metamaterial and the other end of the coaxial probe passes through the two coaxial media;

the waveguide baffle has a pyramid-shaped square hole thereon, for allowing an electron beam to pass through; and the cathode is located at an external side of the square hole;

the collector component comprises a collector and a collector fixing cylinder for fixing the collector and the square waveguide;

two ends of the metamaterial respectively exceed the square waveguide by a quarter of a period length of a metamaterial unit cell so as to realize a high-efficient coupling output of a signal;

adjustable gaskets, for adjusting a position of the square hole, are provided between the waveguide baffle and the rectangular coupling waveguide;

the two coaxial media are made of polytetrafluoroethylene;

the two coaxial media are divided into two sections having different external diameters, wherein an external diameter of a first section which is close to the circular hole of the rectangular coupling waveguide is larger than an external diameter of a second section;

the output transferring cylinder with a flange at one end is externally connected with a standard coaxial connector for outputting the signal.

Based on the background technologies, the present invention provides the metamaterial high-power microwave source having the following benefits:

Firstly, the present invention is high-powered, high-efficient, miniaturized, easy to be manufactured, and liable to integrate with the semiconductor devices.

Secondly, in a relatively wide frequency band (2.85 GHz-2.95 GHz), the present invention has a good transmission characteristic and a low reflection, which guarantees the high-efficient coupling output of the signal.

Thirdly, the present invention realizes a miniaturization, wherein a size of the metamaterial SWS (14.5 mm×14.5 mm) is greatly smaller than a size of a BJ-26 rectangular waveguide (86.36 mm×43.18 mm) of an S band, which facilitates integration with the semiconductor devices.

Fourthly, the present invention has a high-power output and a pulsed output power reaching a megawatt level.

Fifthly, the metamaterial high-power microwave source is able to serve as a signal generator and a signal amplifier.

These and other objectives, features, and advantages of the present invention will become apparent from the following detailed description, the accompanying drawings, and the appended claims.

In the figures, 1-metamaterial SWS, wherein: 1-1-metamaterial; and 1-2-square waveguide; 2-waveguide and coaxial line coupler, wherein: 2-1-waveguide connecting flange; 2-2-rectangular coupling waveguide; 2-3-waveguide baffle; 2-4-coaxial probe; 2-5-medium fixing cylinder; 2-6-coaxial medium A; 2-7-coaxial medium B; 2-8-output transferring cylinder; and 2-9-adjustable gaskets; 3-cathode; and 4-collector component, wherein: 4-1-collector fixing cylinder; and 4-2-collector.

DETAILED DESCRIPTION OF THE PREFERRED EMBODIMENT

The present invention is further illustrated with the accompanying drawings and preferred embodiments.

Referring to FIG. 3-FIG. 8, according to a preferred embodiment of the present invention, a sheet beam metamaterial high-power microwave signal generator which works in a frequency band ranging from 2.85 GHz to 2.95 GHz is provided.

Figure 1:
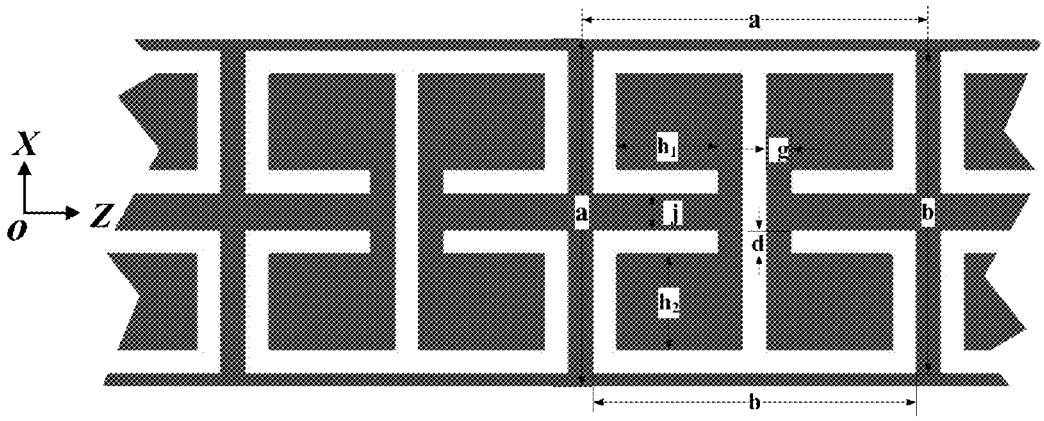
FIG. 1 (Prior art)
FIG. 1 is a structural sketch view (X-Z sectional view) of a metamaterial unit cell according to prior art.
Figure 2:
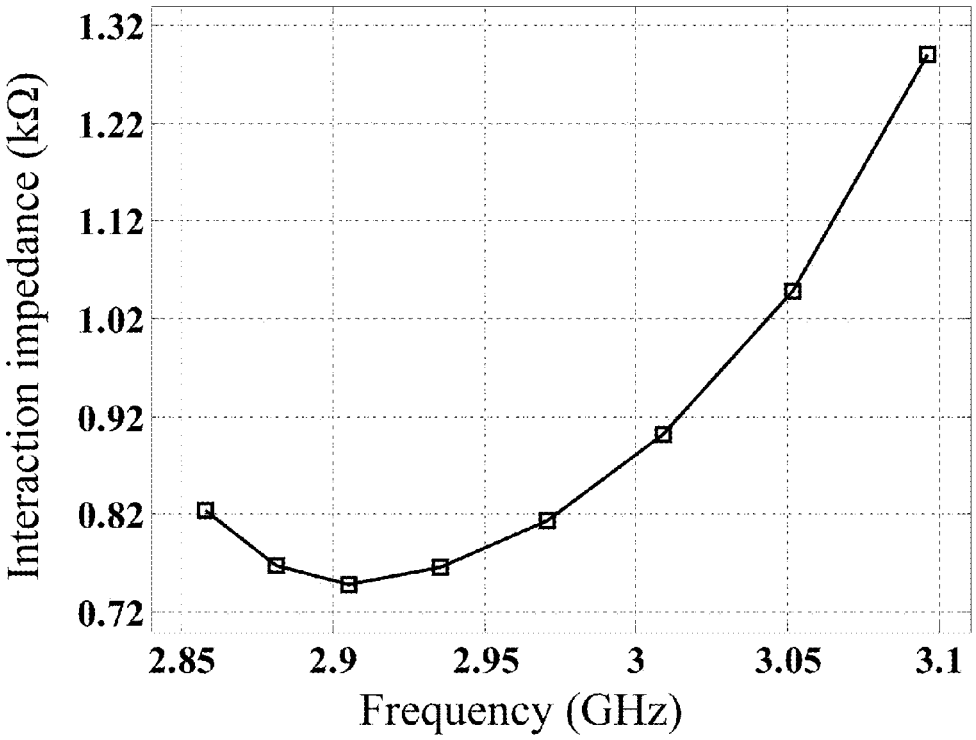
FIG. 2 (Prior art)
FIG. 2 is a diagram of an interaction impedance changing with a frequency according to the prior art.
Figure 3:
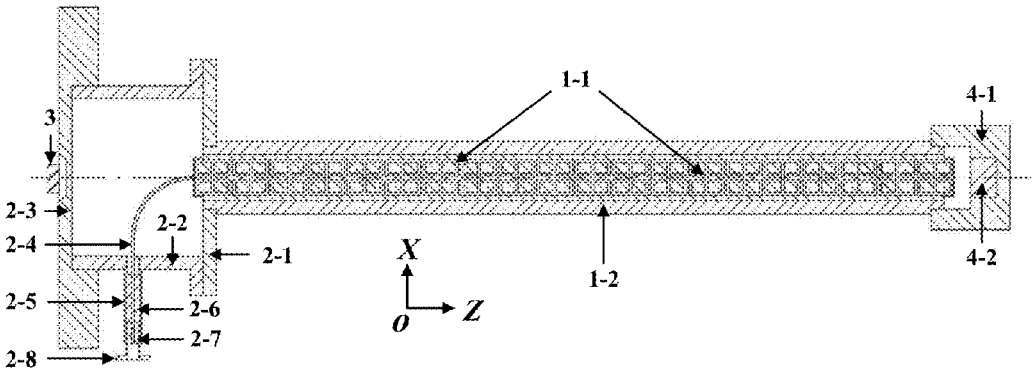
FIG. 3 is a first structural sketch view (X-Z sectional view) of a metamaterial high-power microwave source according to a preferred embodiment of the present invention, wherein a central axis of the metamaterial high-power microwave source overlaps with a coordinate axis Z.
Figure 4:
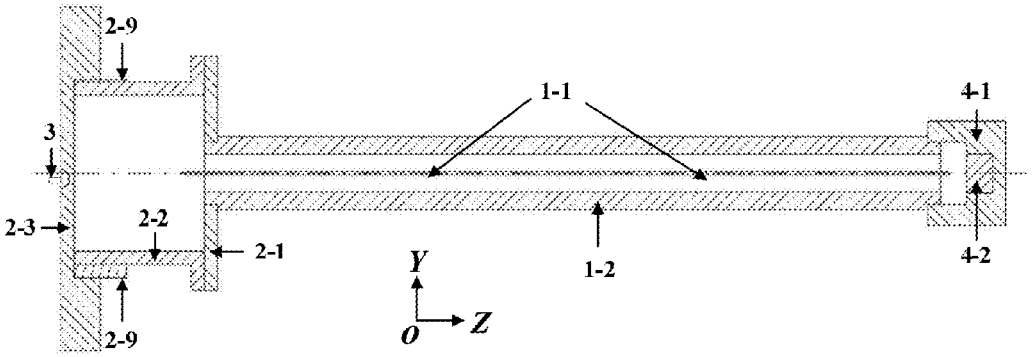
FIG. 4 is a second structural sketch view (Y-Z sectional view) of the metamaterial high-power microwave source according to the preferred embodiment of the present invention.
Figure 5:
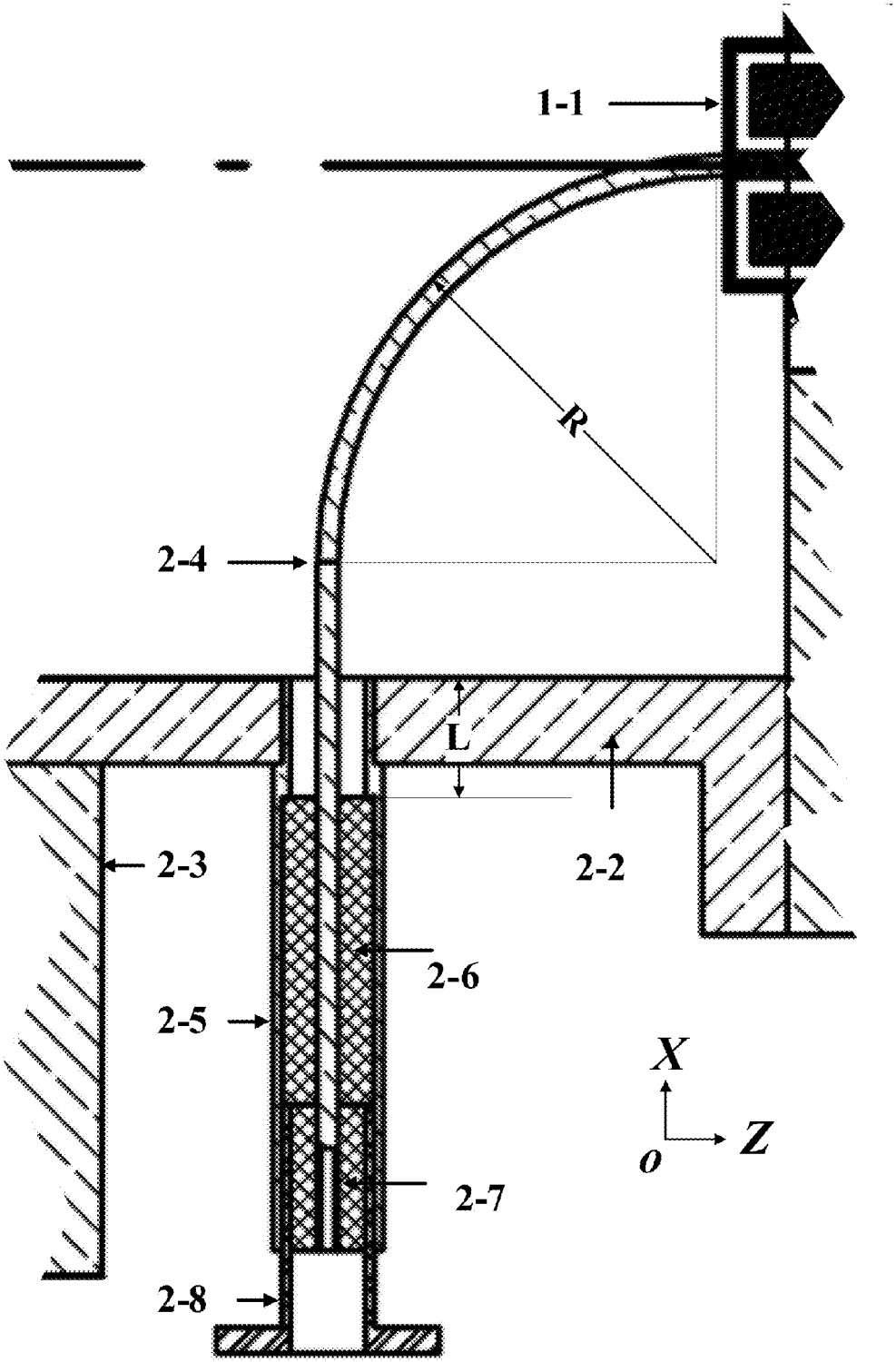
FIG. 5 is a structural sketch view (X-Z sectional view) of a waveguide and coaxial line coupler according to the preferred embodiment of the present invention.

A metamaterial 1-1 is made of oxygen-free copper (OFC). The metamaterial 1-1 has 20 periods and a length of 290 mm. A structural sketch view of each period is showed in the FIG. 1. According to the preferred embodiment of the present invention, a=14.5 mm, b=13.5 mm, $h_1$=4.25 mm, $h_2$=4 mm, g=1 mm, j=1.5 mm, d=1 mm; a thickness of the metamaterial 1-1 is 1.2 mm. A square waveguide 1-2 is made of OFC and has a length of 282.75 mm. A cross section of the square waveguide 1-2 is square. An inner side length of the square waveguide 1-2 is 14.5 mm. Two ends of the metamaterial 1-1 respectively exceed the square waveguide 1-2 by a quarter of a period length of the metamaterial 1-1.

A waveguide connecting flange 2-1 is made of OFC, for fixedly connecting the square waveguide 1-2 with a rectangular coupling waveguide 2-2.

The rectangular coupling waveguide 2-2 is made of OFC. A cross section of the rectangular coupling waveguide 2-2 is square. An inner side length of the rectangular coupling waveguide 2-2 is 60 mm. The rectangular coupling waveguide 2-2 has a length of 50 mm.

A waveguide baffle 2-3 is made of OFC and has a pyramid-shaped square hole at a center of the waveguide baffle 2-3 for an electron beam to pass through. The electron beam is embodied as a sheet electron beam according to the preferred embodiment of the present invention.

A coaxial probe 2-4 is made of OFC and has a diameter of 1.2 mm. The coaxial probe is divided into an arc section and a straight section, wherein: the arc section is a quadrant having an external diameter R of 23.8 mm; and the straight section has a length of 40.3 mm. The straight section of the coaxial probe 2-4 passes through a coaxial medium A 2-6 and a coaxial medium B 2-7. An end of the straight section has a cylindrical hollow part which has a length of 6 mm and an internal diameter of 0.8 mm.

A medium fixing cylinder 2-5 is made of OFC and filled with the two coaxial media, 2-6 and 2-7, having different external diameters. One end of the medium fixing cylinder 2-5 is embedded in a circular hole on a lateral surface of the rectangular coupling waveguide 2-2, for fixing the coaxial media 2-6 and 2-7. A distance L between a step of the medium fixing cylinder 2-5 and an inner surface of the rectangular coupling waveguide 2-2 is 7 mm. The coaxial medium A 2-6 and the coaxial medium B 2-7 are made of polytetrafluoroethylene and have the same internal diameter of 1.2 mm. The coaxial medium A 2-6 has the external diameter of 5.4 mm and a length of 18 mm. The coaxial medium B 2-7 has the external diameter of 4.4 mm and a length of 8.5 mm. The coaxial medium A 2-6 and the coaxial medium B 2-7 can be integrated.

An output transferring cylinder 2-8 is made of stainless steel and has a length of 14.5 mm. One end of the output transferring cylinder 2-8 is embedded into the medium fixing cylinder 2-5; the other end of the output transferring cylinder 2-8 has a connecting flange for connecting with external devices and outputting a signal.

Adjustable gaskets 2-9 are made of OFC, for adjusting a relative deviation between the pyramid-shaped square hole and the metamaterial 1-1. According to the preferred embodiment of the present invention, the relative spacing between a cathode 3 and the metamaterial 1-1 is 2.1 mm.

The cathode 3 is made of stainless steel. An emission surface of the cathode 3 has a size of 12 mm×2 mm.

A collector fixing cylinder 4-1 is made of OFC. A collector 4-2 is made of graphite. An X-Y cross section of the graphite is square, having a side length of 15 mm and a Z-directional thickness of 10 mm.

Figure 6:
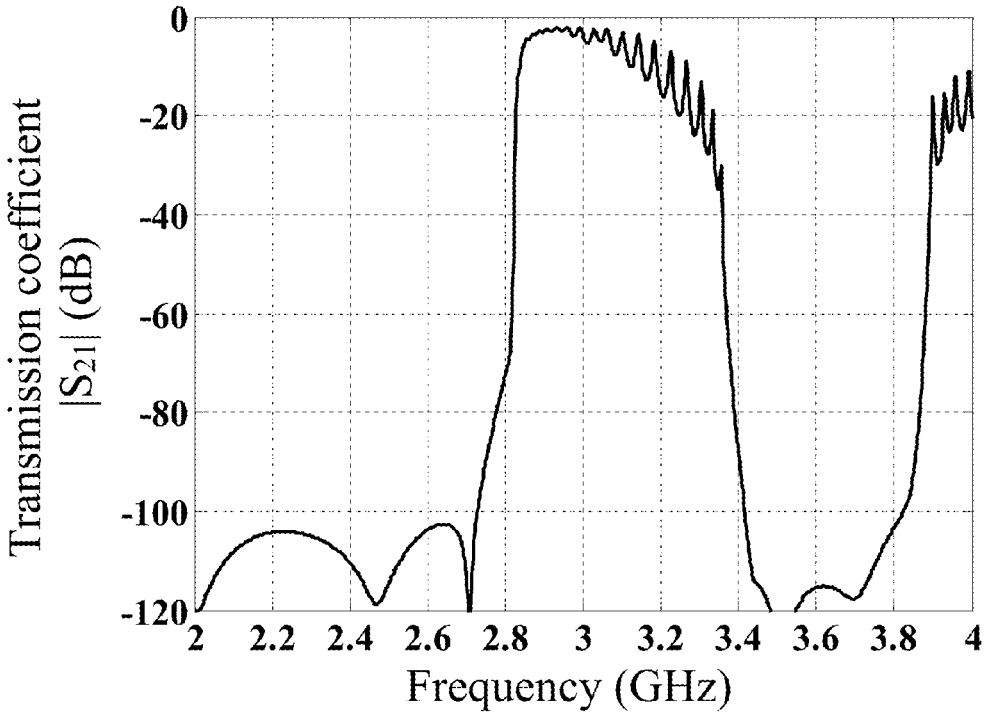
FIG. 6 is a diagram of a transmission coefficient amplitude changing with the frequency according to the preferred embodiment of the present invention.
Figure 7:
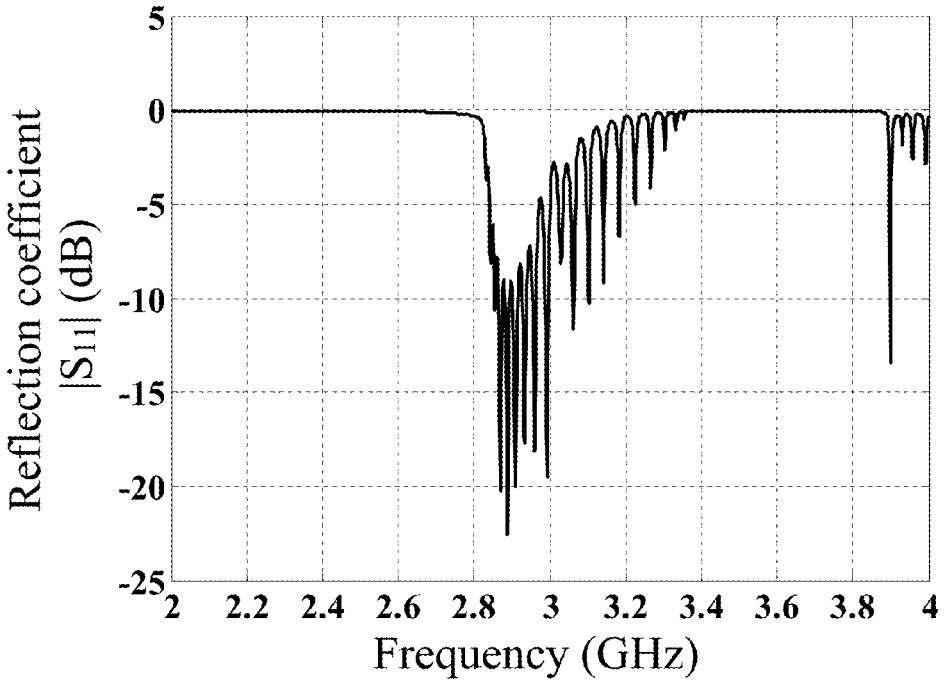
FIG. 7 is a diagram of a reflection coefficient amplitude changing with the frequency according to the preferred embodiment of the present invention.
Figure 8:
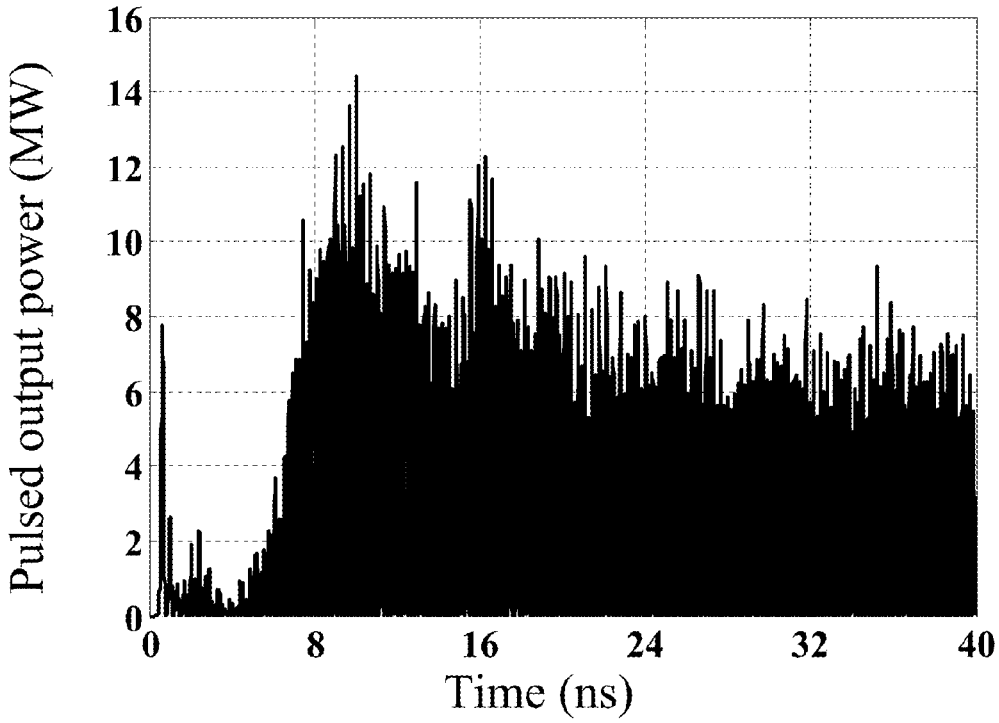
FIG. 8 is a diagram of a pulsed output power changing with time according to the preferred embodiment of the present invention.

Through a simulation, namely replacing a collector component by the waveguide and coaxial line coupler and simulating scattering parameters within the frequency band ranging from 2.85 GHz to 2.95 GHz, it is obtained that $|S_{21}|$ is about −2 dB and $|S_{11}|$ is about −10 dB. Thus, the sheet beam metamaterial high-power microwave signal generator has a good transmission characteristic (as shown in FIG. 6) and a low reflection characteristic (as shown in FIG. 7). Moreover, through simulating a nonlinear beam wave interaction, namely under a condition that the sheet electron beam has a voltage of 220 kV and a beam current of 2.75 kA, it is obtained that a pulsed output power of the microwave signal generator is about 8 MW (as shown in FIG. 8).

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A metamaterial high-power microwave source, comprising: a cathode, a metamaterial slow-wave structure (SWS), a waveguide and coaxial line coupler which is located at one end of said metamaterial SWS, and a collector component which is located at the other end of said metamaterial SWS, wherein:

said metamaterial SWS comprises a square waveguide and a metamaterial which is fixed at a central position of an inner cavity of said square waveguide;

said waveguide and coaxial line coupler comprises a coupling waveguide and a coaxial line;

said coupling waveguide comprises a rectangular coupling waveguide, a waveguide baffle which is located at one end of said rectangular coupling waveguide, and a waveguide connecting flange which is located at the other end of said rectangular coupling waveguide for fixedly connecting said rectangular coupling waveguide with said square waveguide;

said coaxial line comprises a coaxial probe, two coaxial media, a medium fixing cylinder, and an output transferring cylinder;

a central position of a lateral surface of said rectangular coupling waveguide has a circular hole thereon; one end of said medium fixing cylinder is embedded in an external side of said circular hole; the other end of said medium fixing cylinder is embedded in said output transferring cylinder; said medium fixing cylinder is filled with said two coaxial media; one end of said coaxial probe is fixedly connected with said metamaterial; and the other end of said coaxial probe passes through said two coaxial media; and said waveguide baffle has a pyramid-shaped square hole thereon for an electron beam to pass through; and said cathode is located at an external side of said square hole.

2. The metamaterial high-power microwave source, as recited in claim 1, wherein said collector component comprises a collector and a collector fixing cylinder for fixing said collector and said square waveguide.

3. The metamaterial high-power microwave source, as recited in claim 1, wherein two ends of said metamaterial respectively exceed said square waveguide by a quarter of a period length of a metamaterial unit cell.

4. The metamaterial high-power microwave source, as recited in claim 1, wherein adjustable gaskets are provided between said waveguide baffle and said rectangular coupling waveguide, for adjusting a position of said square hole.

5. The metamaterial high-power microwave source, as recited in claim 1, wherein said two coaxial media are made of polytetrafluoroethylene.

6. The metamaterial high-power microwave source, as recited in claim 1, wherein said two coaxial media are divided into two sections having different external diameters; an external diameter of a first section which is close to said circular hole of said rectangular coupling waveguide is larger than an external diameter of a second section.

7. The metamaterial high-power microwave source, as recited in claim 1, wherein said output transferring cylinder has a flange at an end.

8. The metamaterial high-power microwave source, as recited in claim 1, wherein said electron beam is a sheet electron beam or a multi-electron beam.

* * * * *